US010557680B1

(12) United States Patent
Kneebone

(10) Patent No.: US 10,557,680 B1
(45) Date of Patent: Feb. 11, 2020

(54) SLIDE HAMMER ARROW EXTRACTOR

(71) Applicant: Bill Kneebone, Erie, CO (US)

(72) Inventor: Bill Kneebone, Erie, CO (US)

( * ) Notice: Subject to any disclaimer, the term of this patent is extended or adjusted under 35 U.S.C. 154(b) by 0 days.

(21) Appl. No.: 16/410,136

(22) Filed: May 13, 2019

(51) Int. Cl.
*B66C 1/42* (2006.01)
*F41B 5/14* (2006.01)

(52) U.S. Cl.
CPC ..... *F41B 5/1465* (2013.01)

(58) Field of Classification Search
CPC ..... F41B 5/1465
USPC ..... 294/15, 217; 29/253, 254
See application file for complete search history.

(56) References Cited

U.S. PATENT DOCUMENTS 3,441,251 A * 4/1969 Burns ..... B25C 11/00 254/131
4,043,020 A * 8/1977 Hoggard ..... B25B 27/02 29/426.5
4,150,469 A * 4/1979 Hoggard ..... B25B 27/02 124/23.1
4,633,562 A * 1/1987 Ulsh ..... B25B 27/023 29/264
4,920,625 A * 5/1990 Smith ..... B25B 27/023 29/256
5,301,924 A * 4/1994 Kammerer ..... B25B 27/02 254/131
5,408,734 A * 4/1995 Mills ..... B25B 27/023 29/264
5,416,963 A * 5/1995 Boynton ..... B25B 27/023 29/264
5,468,034 A * 11/1995 Kopel ..... F41B 5/1465 29/278
5,682,660 A * 11/1997 Hansen ..... B25B 27/023 29/263
6,148,492 A * 11/2000 Gaulden ..... B25B 27/023 29/263
6,994,385 B2 * 2/2006 Sigears ..... B25B 9/00 294/102.1

* cited by examiner

*Primary Examiner* — Paul T Chin
(74) *Attorney, Agent, or Firm* — Edwin D. Schindler

(57) ABSTRACT

An extraction tool for an embedded arrow head works by attaching a slide hammer shaft to the embedded arrow and then working an outer slide hammer body along the shaft to engage cooperating travel stops to kinetically work the arrow head from a dense material in which the arrow is embedded. The extraction tool includes a handle that may be stored parallel to the slide hammer shaft for transport and then disposed to engage the slide hammer body when needed. The slide hammer shaft has an arrow head engagement end with a threaded receiver and a distal stop bolt end that includes for a separate grip and an ancillary attachment.

14 Claims, 10 Drawing Sheets

SLIDE HAMMER ARROW EXTRACTOR

BACKGROUND OF THE INVENTION

The present invention relates, generally to tools and, more particularly, to an apparatus and related method for extracting embedded arrows heads from dense material, such as a tree trunk or the like.

SUMMARY OF THE INVENTION

A primary object of the present invention is to provide a manual apparatus for extracting embedded arrow heads from dense materials, such as trees. The extraction tool has an inner cylindrical shaft attached at one end to the embedded arrow and an outer slide hammer body that moved freely along it and, once attached, is used to urge the stuck arrow out with an attached handle. There are cooperating peripheral stops on both the cylinder shaft and the outer slide hammer body.

Another object of the present invention is to provide an arrow head extraction tool comprising a longitudinal slide hammer shaft with a first end receiver for releasably attaching the extraction tool to an embedded arrow head.

Yet another object of the present invention is to provide the longitudinal slide hammer shaft with a second end including an exterior stop serving as handle during extraction use and also including means of attaching to apparel or ancillary equipment during transport.

Still yet another object of the present invention is to provide a slide hammer body having a throughbore where the slide hammer shaft is slidably moveable within the body.

Another object of the present invention is to provide the longitudinal slide hammer shaft with a first end stop to limit the movement within the slide hammer body throughbore.

Yet another object of the present invention is to provide the slide hammer body a plurality of handle receiving portions to engage a provided handle both in a stored position and an operative position.

Still yet another object of the present invention is to provide an embedded arrow head removal tool having a small cross section area while in storage or transmit that is movable to a transverse position thereby allowing a greater impact force impinged on the arrow head and the statically attached extractor body.

Additional objects of the present invention will appear as the description proceeds.

The present invention overcomes the shortcomings of the prior art by providing a tool attachable to an embedded arrow head that uses a slide hammer body member moving along the attached tool's long axis. The long attached body further provides a handgrip approximate the stop end used along with a handle on the hammer body to apply force to the embedded arrow head and additionally serves as a latchable support to apparel or ancillary equipment.

More particularly, the present invention provides an extraction tool for removing an embedded arrow head from a dense material, which includes a slide hammer shaft having a first end and a second end, in which the first end includes an arrow head receiving portion and the second end includes a stop bolt receiving portion and with the second end further includes a peripheral slide hammer shaft stop. A slide hammer body is further includes and has a longitudinal throughbore and a slide hammer body contact head with the longitudinal throughbore dimensioned for receiving the slide hammer shaft and wherein the slide hammer shaft is freely movable therein; the slide hammer body further including two handle receiving portions, a first in-use handle receiving portion being disposed perpendicular to the slide hammer body throughbore and a second handle storage receiving portion being disposed parallel to the slide hammer body throughbore. An extraction tool handle includes a handle attachment for allowing the handle to be alternately received in either the in-use handle receiving portion or the handle storage receiving portion, whereby a user may detach the arrow shaft from the embedded arrow head and attach the free arrow head to the arrow head receiving portion on the slide hammer shaft, then attach the extraction tool handle to the in-use receiving portion on the slide hammer body and, thereafter, by sliding the slide hammer body along the slide hammer shaft for bringing the slide hammer body contact head and the peripheral slide hammer shaft stop into contact, thereby kinetically working out the embedded arrow head and thereby desirably providing a manual apparatus for releasably engaging and applying a force to remove an embedded arrowhead from a dense material.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views.

DESCRIPTION OF THE REFERENCED NUMERALS

Figure 1:
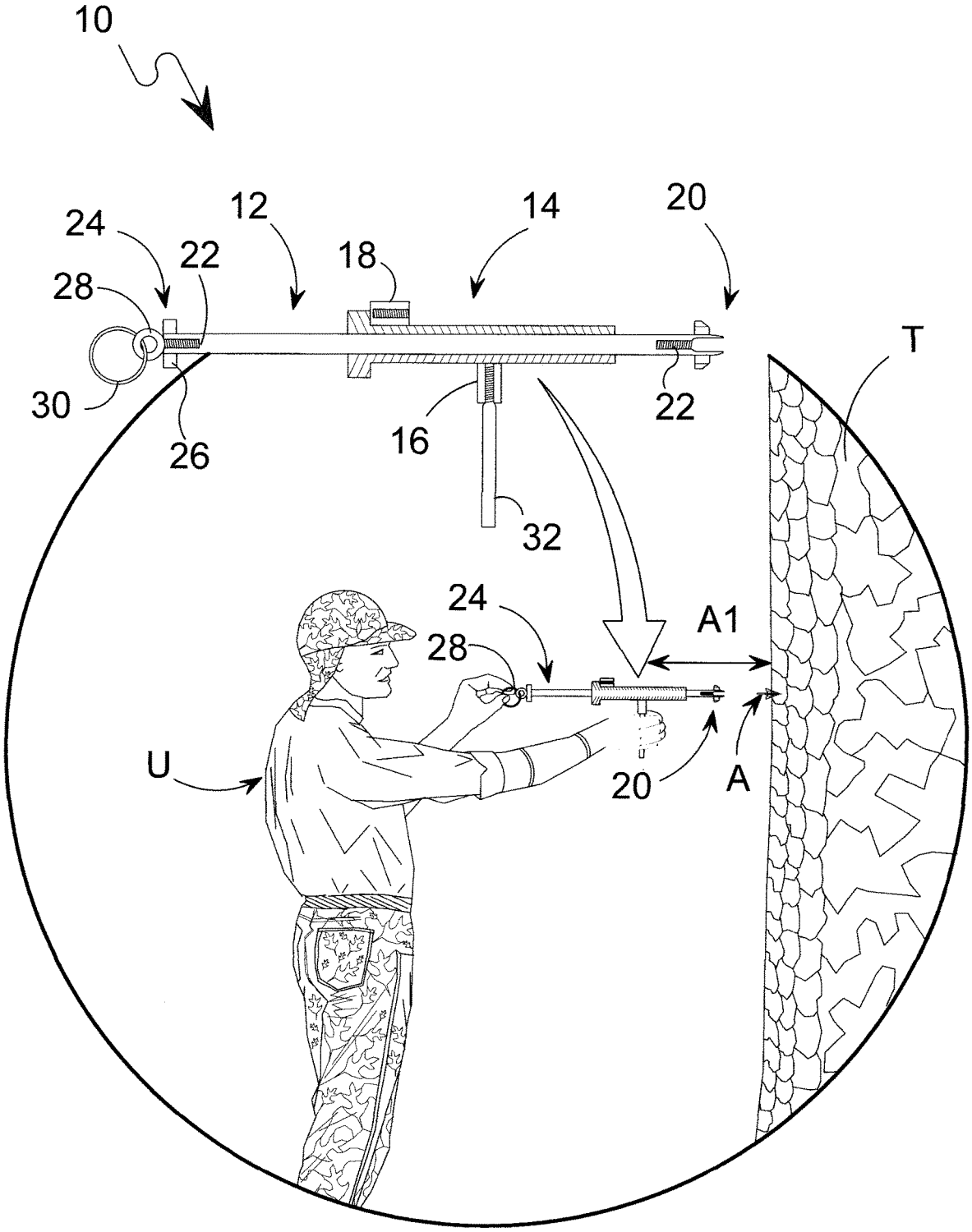
FIG. 1 is an overview of the present invention in use.

Turning now descriptively to the drawings, in which similar reference characters denote similar elements throughout the several views, the figures illustrate the use of the present invention. With regard to the reference numerals used, the following numbering is used throughout the various drawing figures:

U user
A embedded arrow head
T tree trunk
10 extraction tool/instant invention
12 slide hammer shaft
14 slide hammer body
16 hammer body handle receiving portion
18 hammer body handle storage portion
20 slide hammer shaft arrow head receiving first end
22 hammer shaft arrow head receiver
24 slide hammer shaft stop second end
26 peripheral slide hammer shaft stop
28 stop end bolt
30 ancillary attachment means
32 slide hammer body handle
34 slide hammer shaft stop end bolt receiver
36 threaded handle storage receiver
38 threaded handle in-use receiver
40 slide hammer body throughbore
42 slide hammer body contact head
44 stop end bolt threaded end
46 handle threaded end
48 arrow shaft
50 arrow head threaded end
A1 arrow head engagement directional arrow
A2 slide hammer directional arrow

DETAILED DESCRIPTION OF THE DRAWING FIGURES AND PREFERRED EMBODIMENTS

When an arrow is embedded in a tree it can be both difficult and dangerous to extract it. In FIG. 1 the user U is employing the present invention indicated at 10 to the remove the embedded arrow head A. The slide hammer shaft portion 12 has an arrow head receiving end 20 and a stop end bolt end 24. The arrow head receiving end 20 also has a threaded arrow head receiver 22 that will engage the threaded portion of the arrow head A as seen in FIG. 1 with directional arrow A1. The user U holds the present invention 10 by both handle 32 and stop end bolt 28.

Figure 2:
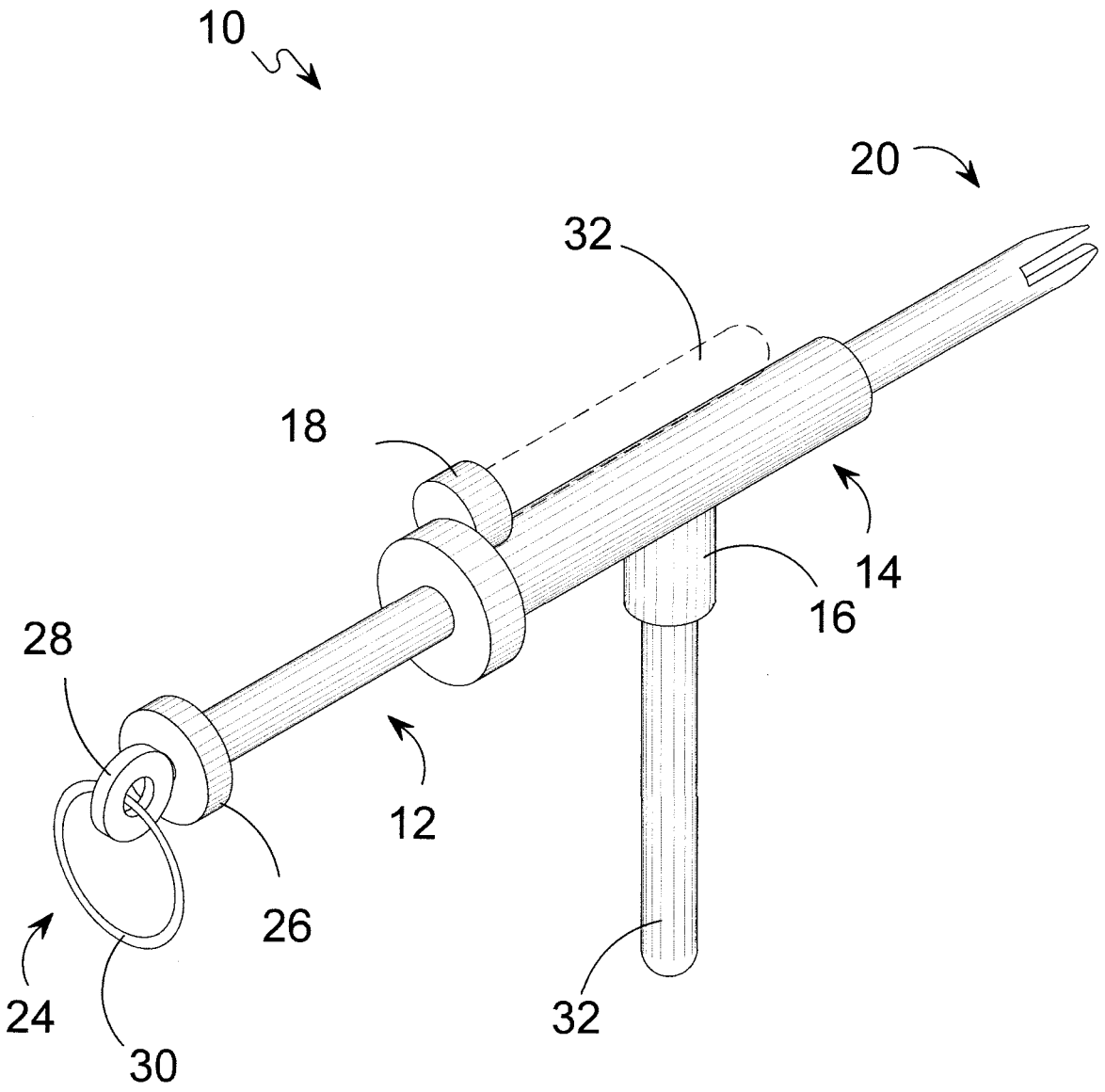
FIG. 2 is a perspective view of the arrow head extractor of the present invention.

The present invention 10 is seen in more detail in FIG. 2. The inner slide hammer shaft 12 has the first end 20 and a second end 24. Second end 24 has a peripheral stop 26 extending outwards as shown and also includes stop end bolt 28 and the ancillary attachment means 30. These will be discussed further below. Handle 32 is seen engaged in FIG. 2 with the handle receiving portion 16 of the slide hammer body 12.

Figure 3A:
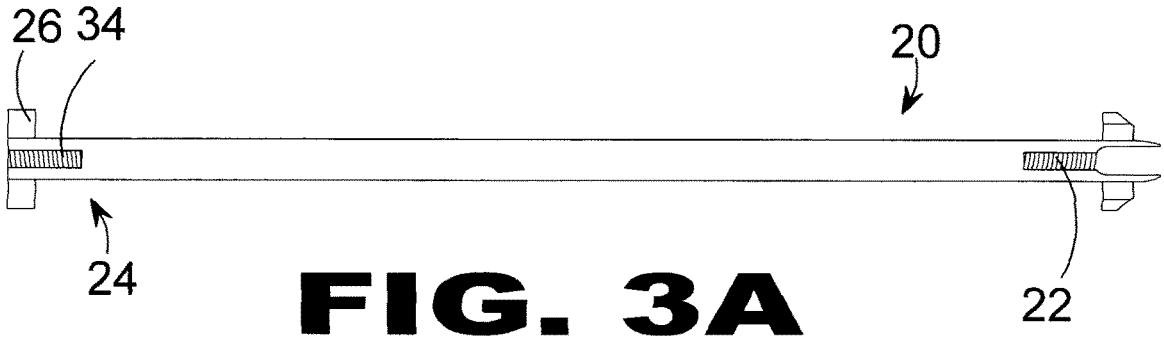
FIG. 3A is a side and partial cutaway view of the slide hammer shaft of the present invention.
Figure 3B:
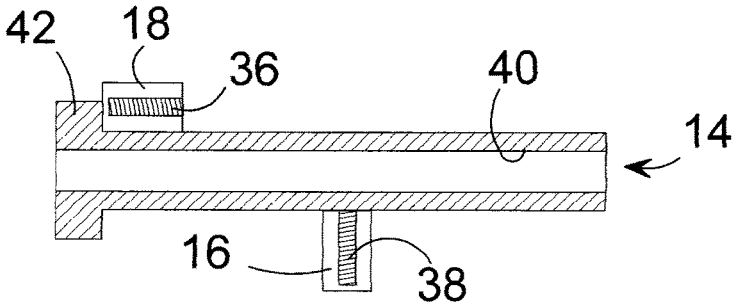
FIG. 3B is a side and partial cutaway view of the slide hammer body of the present invention.
Figure 3C:
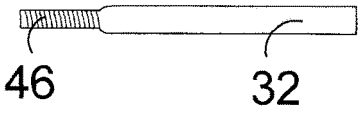
FIG. 3C is a side view of the handle of the arrow head extractor of the present invention.
Figure 3D:
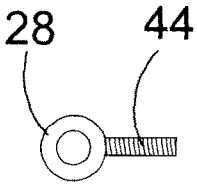
FIG. 3D is a side view of the stop end bolt of the arrow head extractor of the present invention.
Figure 3E:
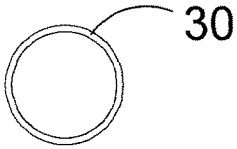
FIG. 3E is an enablement of an ancillary attachment means of the arrow head extractor of the present invention.

Turning now, to FIGS. 3A through 3E, more of the various parts of the present invention 10 are seen in these views. In FIG. 3A the slide hammer shaft 12 has threaded arrow head receiver portion 22 at one end and a threaded stop end bolt receiver 34 at the other. Also at the stop bolt end 24 is the slide hammer stop periphery 26. The slide hammer body 14, in FIG. 3B, has a throughbore 40 and a slide hammer contact stop 42. There are two handle receivers 16, 18 for use and storage respectively. In FIG. 3C, handle 32 has a threaded portion 46 that engages either. The stop end bolt 28, in FIG. 3D likewise has a threaded portion 44 that engages the receiver 34 on shaft 12. It is contemplated that stop end bolt 28 be large enough to be easily handled, yet not so large as to hinder transport or storage. In FIG. 3E ancillary attachments are indicated at 30 and could be as shown, a hook and loop attachment, a retractable attachment, or the like.

Figure 4:
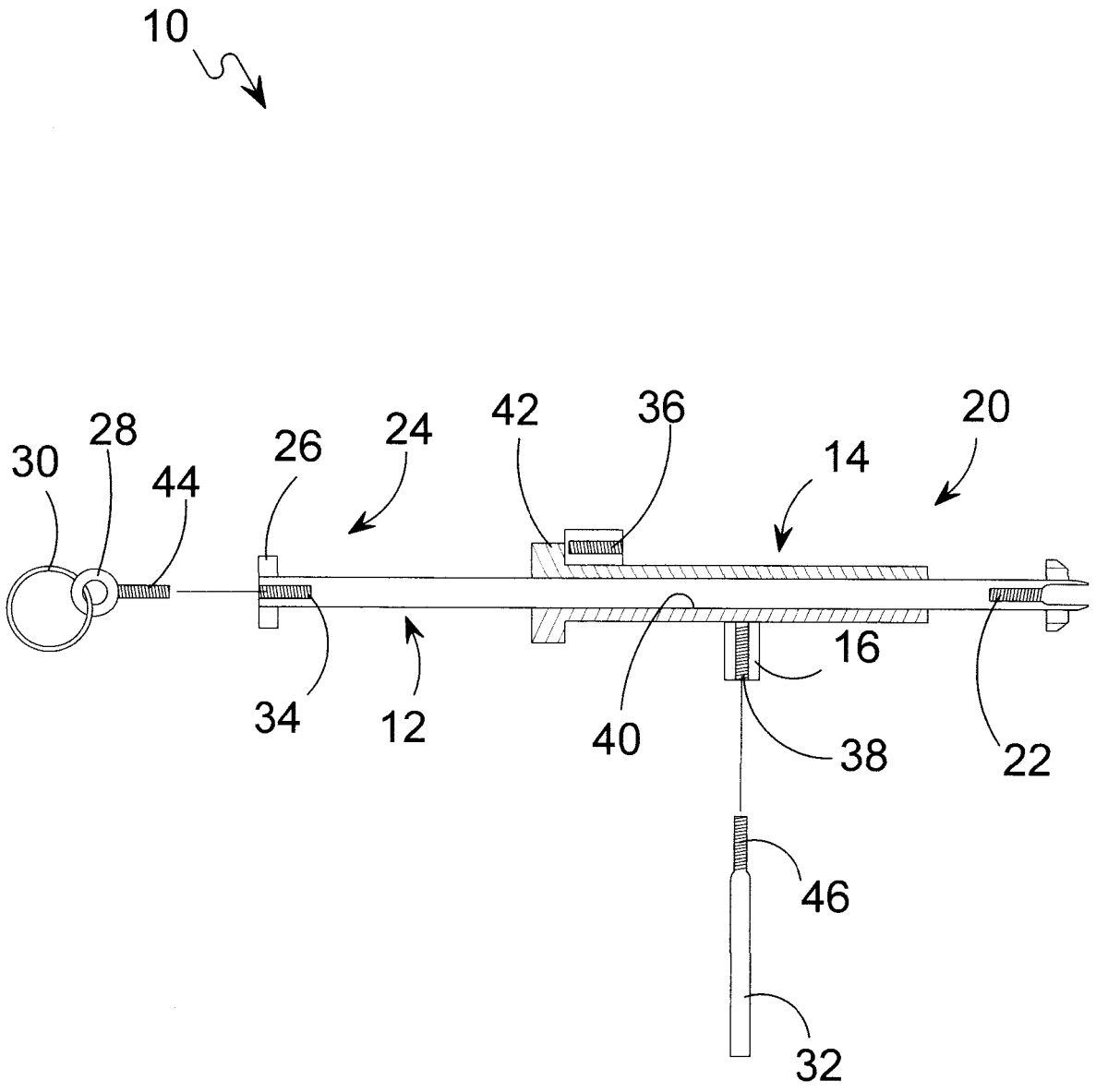
FIG. 4 is a partially exploded view of the arrow head extractor of the present invention.

Turning to FIG. 4, the stop end bolt 28 with its threaded end 44 is seen ready to be engaged with the slot bolt end receiver 34 and that the handle 32 may be inserted into the handle receiver 38 of the receiving portion 16. As can be seen from the Figures, this is contemplated as accomplished by threaded means, though other engageable attachments could be used.

Figure 5:
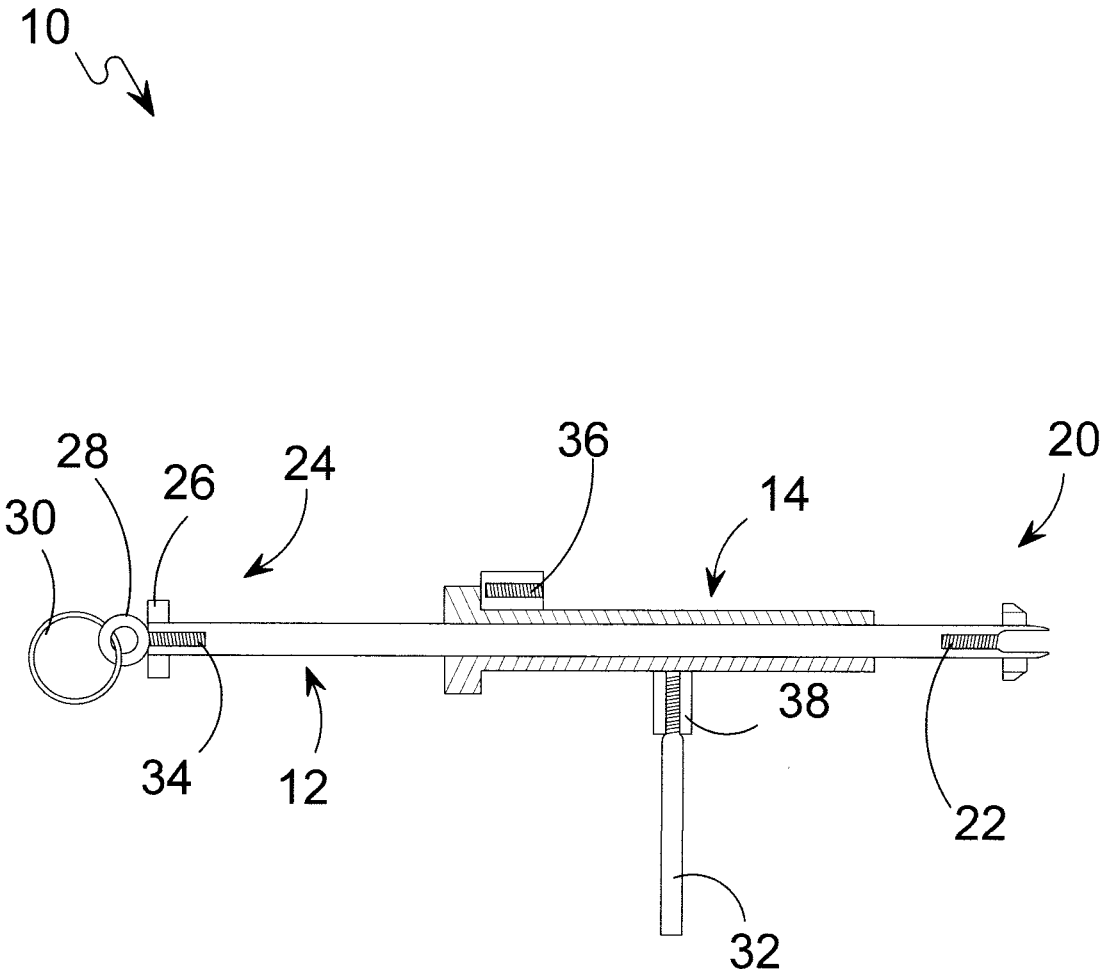
FIG. 5 is further cutaway view of the arrow head extractor of the present invention.

In FIG. 5 the stop bolt 28 and the handle 32 are in place and the extraction tool 10 is ready for use.

Figure 6:
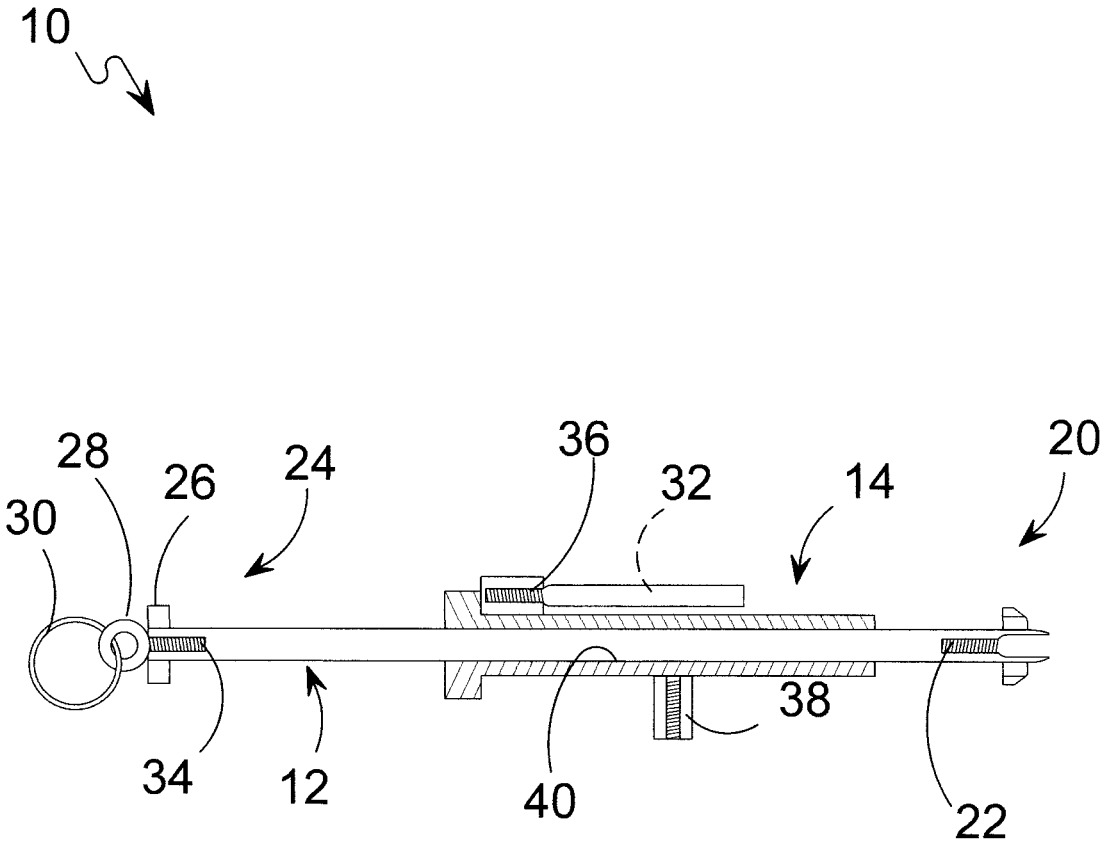
FIG. 6 is another cutaway view of the arrow head extractor with the handle portion in the stored position.

FIG. 6 shows the extraction tool 10 of the present invention with the handle 32 engaged in the storage position. This involves the threaded end 46 of handle 32 being engaged with the storage position receiver 36 of the handle storage portion 18.

Figure 7:
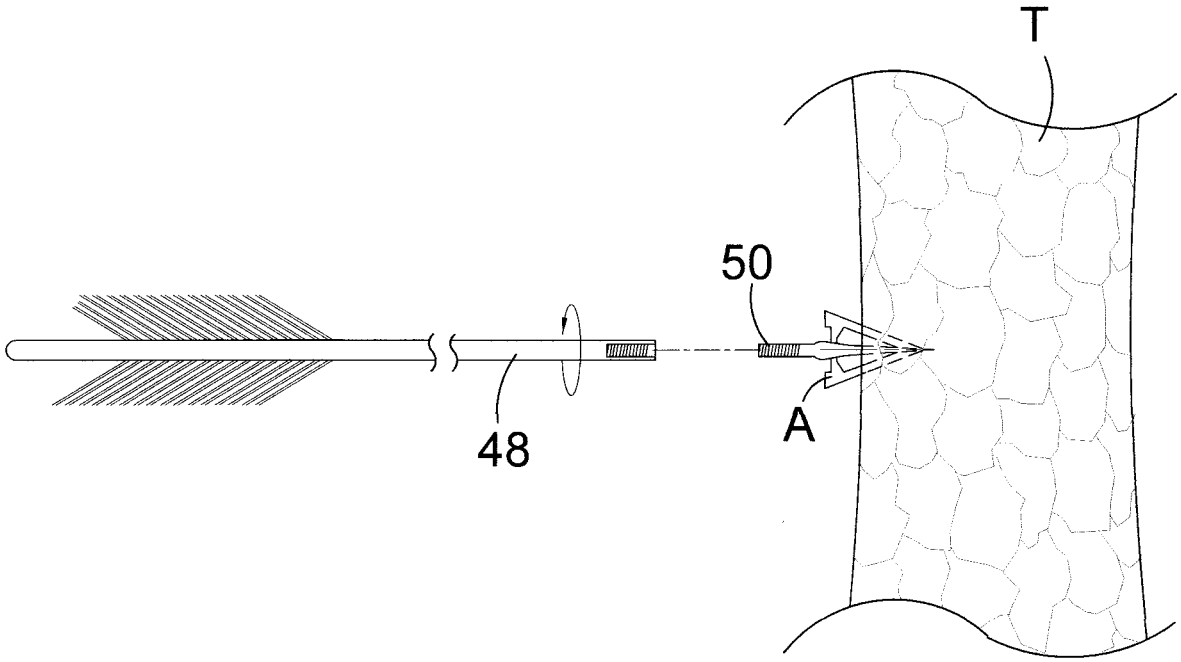
FIG. 7 is a plan view of the arrow head extractor showing the removal of the arrow shaft from the arrow head.

When the arrow head A is embedded in a tree T as seen in FIG. 7, the arrow shaft 48 may be detached from the arrow head A as shown. The arrow head threaded end 50 may then be engaged with the threaded arrow head receiver 22 on the slide hammer shaft 12.

Figure 8:
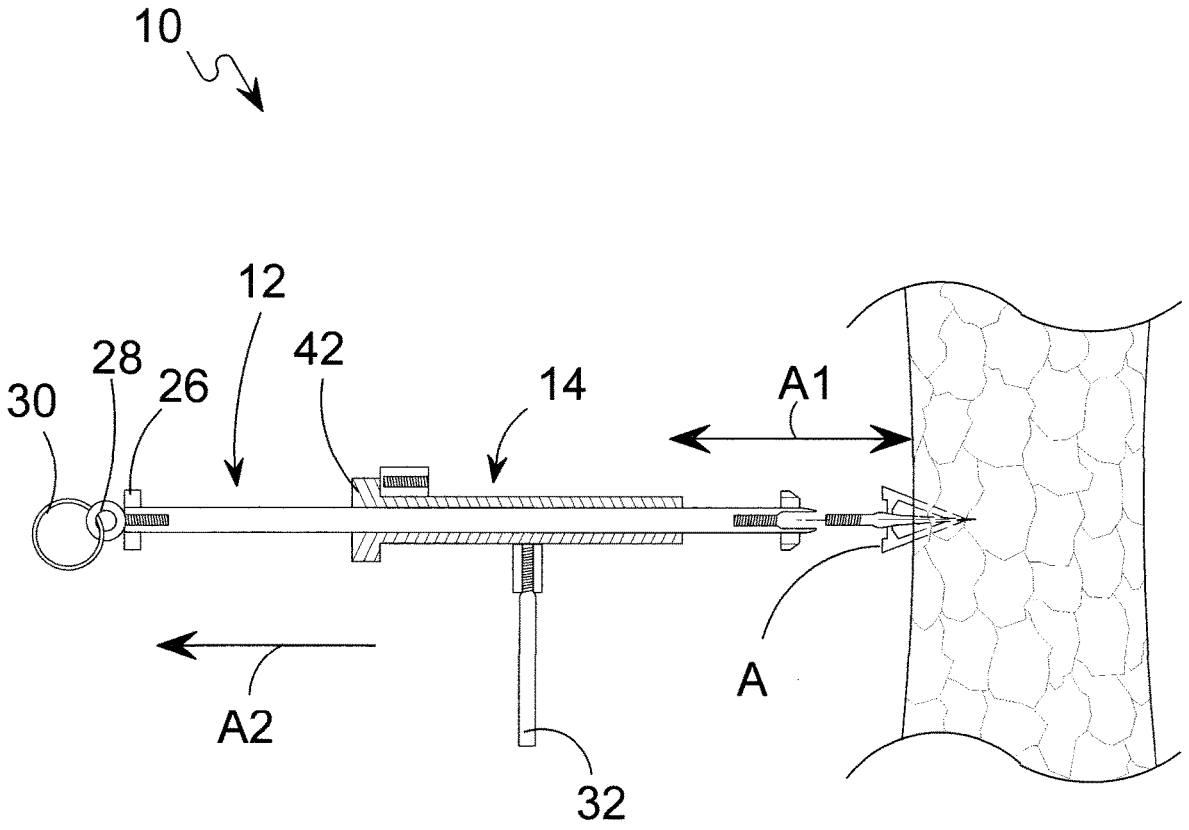
FIG. 8 is a cross-sectional view of embedded arrow extractor in use.

This is seen in FIG. 8 where the arrow head A is ready to be engaged as indicated by directional arrow A1. Once the arrow head A is engaged, by moving the outer slide hammer body 14 as indicated by directional arrow A2 the contact surfaces 42 and 26 are brought into sharp contact, working the arrow head A out of the tree trunk T.

Figure 9:
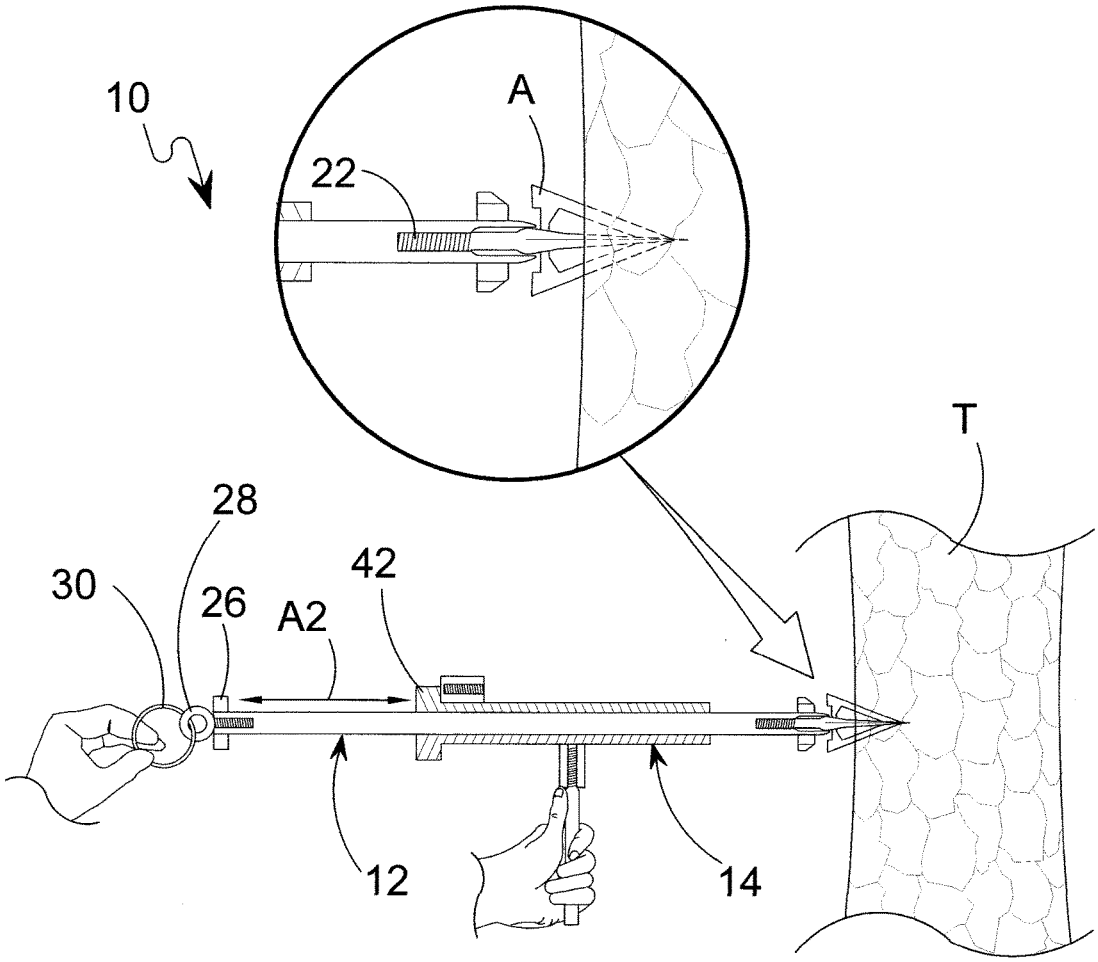
FIG. 9 is a further overview of the embedded arrow head extractor of the present invention; and, FIG. 10 is an additional overview of the arrow head extractor of the present invention.

As can be seen in FIG. 9, the movement of the slide hammer body 14 along the slide hammer shaft 12 as indicated at A1 will bring the arrow head A out of the tree trunk T. It can be seen from FIG. 9 that the user U may easily grasp the extraction tool 10 and safely remove the arrow head A.

Figure 10:
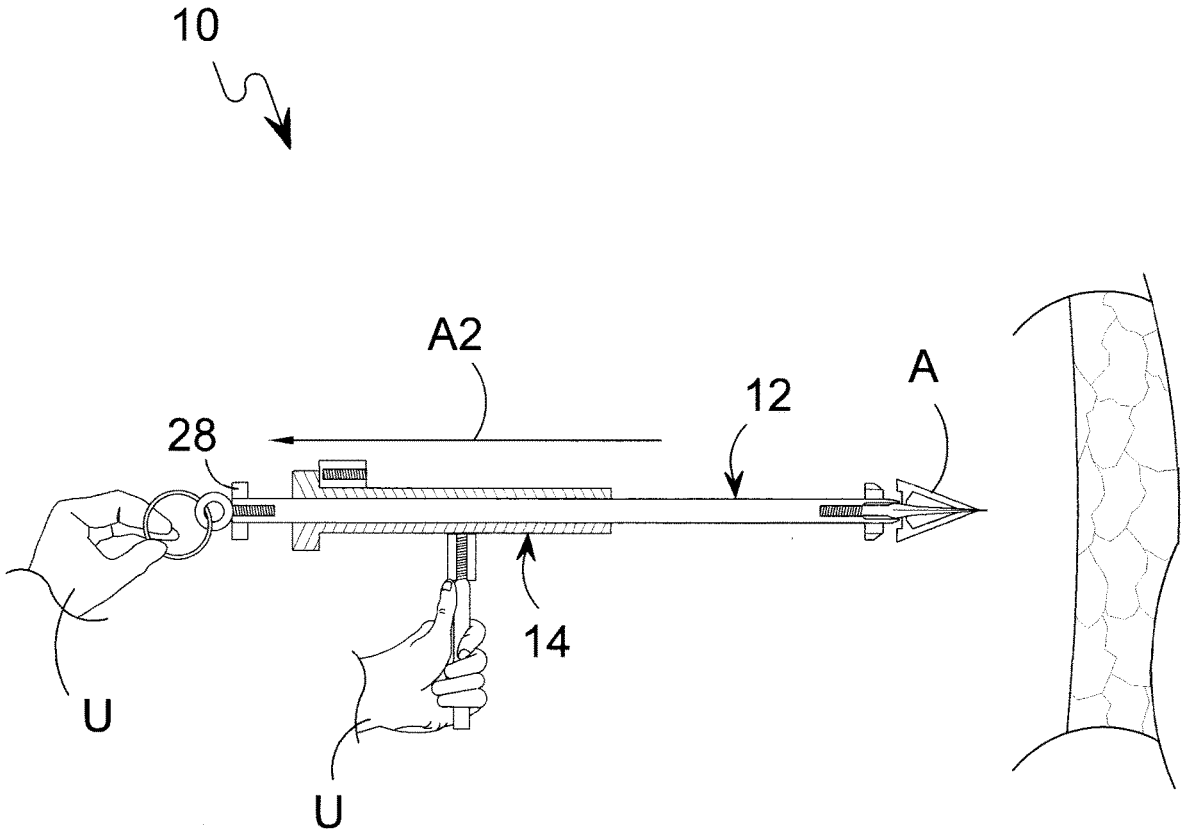

After the arrow head A is removed as seen in FIG. 10 the user U may detach the arrow head by unscrewing it from the arrow head receiver portion 20 of the slide hammer shaft 12.

It is contemplated that the present invention 10 could be made from a plurality of materials, or combination of materials. Metals or composites for lightness and durability could be used. The ancillary attachment means 30 is seen as a key ring-type object in the Figures. As mentioned above, both this and the stop end bolt 28 could be many different configurations. The present invention 10 is designed to be easily carried and deployed in the field, to quickly disengage an embedded arrow head from a tree trunk or the like.

While only several embodiments of the present invention have been shown and described, it will be obvious to those skilled in the art that many modifications may be made to the present invention without departing from the spirit and scope thereof.

What is claimed is:

1. An extraction tool for removing an embedded arrow head from a dense material, comprising:

a handle;

a slide hammer shaft having a first end and a second end, said first end including an arrow head receiving portion and said second end including a stop bolt receiving portion and a peripheral slide hammer shaft stop;

a slide hammer body having a longitudinal throughbore and a slide hammer body contact head, said longitudinal throughbore dimensioned for receiving said slide hammer shaft with said slide hammer shaft being freely movable therein, said slide hammer body further including a first handle receiving portion and a second handle receiving portion, said first handle receiving portion being an in-use handle receiving portion disposed perpendicular to said slide hammer body throughbore and a second handle receiving portion being a handle storage receiving portion disposed parallel to said slide hammer body throughbore; and, an extraction tool handle including a handle attachment for allowing said handle to be alternately received in either said in-use handle receiving portion or said handle storage receiving portion, wherein a user is able to a shaft of an arrow from an embedded arrow head and attach a free arrow head to said arrow head receiving portion on said slide hammer shaft, attach said handle to said in-use receiving portion on said slide hammer body and, by sliding said slide hammer body along said slide hammer shaft, bringing said slide hammer body contact head and said peripheral slide hammer shaft stop into contact, thereby removing the embedded arrow head.

2. The extraction tool for removing an embedded arrow head from a dense material according to claim 1, wherein said arrow head receiving portion is a threaded aperture for receiving a threaded end of an arrow head.

3. The extraction tool for removing an embedded arrow head from a dense material according to claim 1, further comprising a stop bolt with said stop bolt receiving portion being a threaded aperture for receiving a threaded stop bolt end, wherein said stop bolt includes said threaded stop bolt end and a grip portion.

4. The extraction tool for removing an embedded arrow head from a dense material according to claim 3, wherein said grip portion of said stop bolt is ring-shaped for securely gripped by a user's hand.

5. The extraction tool for removing an embedded arrow head from a dense material according to claim 4, wherein said stop bolt further includes an ancillary attachment for attaching said extraction tool for transport.

6. The extraction tool for removing an embedded arrow head from a dense material according to claim 5, wherein said ancillary attachment is a keychain ring.

7. The extraction tool for removing an embedded arrow head from a dense material according to claim 1, wherein handle attachment includes a threaded portion able to be received in said first handle receiving portion for disposing said handle perpendicularly to the throughbore of said slide hammer body for allowing the user to move said slide hammer body along said slide hammer shaft.

8. The extraction tool for removing an embedded arrow head from a dense material according to claim 1, wherein handle attachment includes a threaded portion able to be received in said second handle receiving portion for disposing said handle parallel to the throughbore of said slide hammer body for allowing the user to transport or store said extraction tool.

9. A method for extracting an embedded arrow head from a dense material, comprising the steps of:

detaching the embedded arrow head from an accompanying arrow shaft;

providing an extraction tool including a slide hammer shaft that is removably attachable to the embedded arrow head;

attaching said slide hammer shaft to said embedded arrow head;

providing a slide hammer body that includes a longitudinal throughbore dimensioned for receiving said slide hammer shaft so that said slide hammer shaft freely moves therein and said slide hammer body travels along said slide hammer shaft and further providing a set of cooperating contact stops on both said slide hammer shaft and said slide hammer body; and, moving said slide hammer body along said slide hammer shaft for bringing said cooperating contact stops together for kinetically working the embedded arrow head from the dense material.

10. A method for extracting an embedded arrow head from a dense material according to claim 9, further comprising the step of providing a threaded aperture on said slide hammer shaft for engaging the embedded arrow head.

11. The method for extracting an embedded arrow head from a dense material according to claim 9, further comprising the step of providing a grip portion on said slide hammer shaft for manipulating said extraction tool when engaging the embedded arrow head.

12. The method for extracting an embedded arrow head from a dense material according to claim 9, further comprising the step of providing a slide hammer body handle for assisting in moving said slide hammer body along said slide hammer shaft.

13. The method for extracting an embedded arrow head from a dense material according to claim 12, wherein said slide body handle includes a threaded portion and said slide hammer body includes a first handle receiving portion configured so that said slide body handle is able to be located perpendicularly to the longitudinal throughbore of said slide hammer body for use.

14. The method for extracting an embedded arrow head from a dense material according to claim 12, wherein said slide body handle includes a threaded portion and said slide hammer body includes a second storage handle receiving portion configured so that said slide body handle is able to be located parallel to the longitudinal throughbore of the slide hammer body for transport or storage.

* * * * *